US010680387B2

(12) United States Patent
Cheng et al.

(10) Patent No.: US 10,680,387 B2
(45) Date of Patent: Jun. 9, 2020

(54) ELECTRICAL CONNECTOR WITH IMPROVED SHIELDING PLATE

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventors: Shan-Yong Cheng, New Taipei (TW); Feng Bao, Kunshan (CN); Quan Wang, Kunshan (CN); Wen He, Kunshan (CN)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/238,535

(22) Filed: Jan. 3, 2019

(65) Prior Publication Data

US 2019/0229470 A1 Jul. 25, 2019

Related U.S. Application Data

(60) Provisional application No. 62/746,008, filed on Oct. 16, 2018.

(30) Foreign Application Priority Data

Jan. 3, 2018 (CN) ..... 2018 2 0005493 U

(51) Int. Cl.
*H01R 13/6585* (2011.01)
*H01R 13/405* (2006.01)
(Continued)

(52) U.S. Cl.
CPC ..... *H01R 13/6585* (2013.01); *H01R 13/405* (2013.01); *H01R 24/60* (2013.01); *H01R 13/6471* (2013.01); *H01R 2107/00* (2013.01)

(58) Field of Classification Search
CPC ..... H01R 13/6585; H01R 13/405
See application file for complete search history.

(56) References Cited

U.S. PATENT DOCUMENTS 9,214,766 B1 * 12/2015 Yu ..... H01R 13/6585
9,350,121 B2 * 5/2016 Ju ..... H01R 13/6585
(Continued)

*Primary Examiner* — Abdullah A Riyami
*Assistant Examiner* — Nader J Alhawamdeh
(74) *Attorney, Agent, or Firm* — Wei Te Chung; Ming Chieh Chang

(57) ABSTRACT

An electrical connector includes a terminal module including a base, a mating tongue, a row of first terminals, a row of second terminals and a shielding plate. Terminals comprise contacting portions, middle portions and leg portions. Each row of terminals comprises three pairs of differential signal terminals, and grounding terminals and power terminals. The shielding plate defines a first row of openings corresponding to the contacting portions, a second row of openings and third row of openings both corresponding to the middle portion. The first row of openings are aligned with the contacting portions of the first and second terminals in a vertical direction and the second row of openings are at least aligned with gaps between every two adjacent terminals while the shielding plate defines no opening corresponding to the middle portions of the three pair of differential signal terminals so as improve shielding performance.

20 Claims, 27 Drawing Sheets

(51) Int. Cl.

| | |
|---|---|
| ***H01R 24/60*** | (2011.01) |
| *H01R 13/6471* | (2011.01) |
| *H01R 107/00* | (2006.01) |

(56) References Cited

U.S. PATENT DOCUMENTS

| | | | | |
|---|---|---|---|---|
| 9,379,499 | B2 * | 6/2016 | Miyoshi | H01R 24/60 |
| 9,564,716 | B2 * | 2/2017 | Kao | H01R 13/6586 |
| 9,647,369 | B2 * | 5/2017 | Tsai | H01R 4/02 |
| 9,768,567 | B2 * | 9/2017 | Cheng | H01R 24/60 |
| 10,008,793 | B2 * | 6/2018 | Ju | H01R 24/78 |
| 10,069,247 | B1 * | 9/2018 | Tseng | H01R 13/658 |
| 2015/0255905 | A1 * | 9/2015 | Little | H01R 13/6658 439/78 |
| 2016/0104976 | A1 * | 4/2016 | Yu | H01R 13/6585 439/607.05 |
| 2016/0141806 | A1 * | 5/2016 | Guo | H01R 13/504 439/607.01 |
| 2016/0352052 | A1 * | 12/2016 | Yu | H01R 13/6585 |

* cited by examiner

ELECTRICAL CONNECTOR WITH IMPROVED SHIELDING PLATE

BACKGROUND OF THE DISCLOSURE

1. Field of the Disclosure

The present disclosure relates to an electrical connector, and more particularly to an electrical connector having the USB Type C mechanical configuration mechanically with some variation of the Display Port electrical characters.

2. Description of Related Arts

USB Type C connectors have been more and more popularly used in the communication field since August 2014 when it was first publicly announced. The traditional USB Type C receptacle connector essentially includes a mating tongue with two rows of contacts exposed on two opposite mating surfaces of the mating tongue and a metallic shielding plate embedded within the mating tongue between the two rows of contacts. The two rows of contacts are totally twenty-four contacts with the pin assignment. Notably, the middle shielding plate is used for shielding, grounding and reinforcing for the whole connector as mentioned in U.S. Pat. No. 9,484,681. Anyhow, during practical use other issues other than the shielding, grounding and reinforcing issues are involved with and concerned about, including how to cooperate, by means of some contact positioning holes and housing forming holes during making the whole connector via an insert-molding process with a successive assembling process, and/or avoid the potential sparkling under a high power voltage delivery, etc. Anyhow, because the space in the shielding plate is limited, it is relatively difficult to design a metallic shielding plate to meet all the requirements in making an electrical Type C receptacle connector, either mechanically in making or electrically in using. In other words, the hole arrangement in the metallic shielding plate is required to be balanced from the mechanical viewpoint and the electrical viewpoint.

An improved electrical connector is desired.

SUMMARY OF THE DISCLOSURE

An object of the present disclosure is to provide a USB Type C receptacle connector with a metallic shielding plate in the mating tongue wherein the shielding plate is equipped with specifically arranged holes therein for meet not only the mechanical requirement during manufacturing but also the electrical requirement during using in a high frequency transmission.

To achieve the above object, an electrical connector comprises a terminal module comprising a base, a mating tongue extending from the base and defining two opposite surface, and a row of first terminals, a row of second terminals and a shielding plate embedded in the base and the mating tongue. The mating tongue defines a thickened step at a root to the base; the first terminals and the second terminals comprise contacting portions, middle portions and leg portions bending from the middle portions; the shielding plate is located between the two opposite surfaces. Each row of first and second terminals comprises three pairs of differential signal terminals, and grounding terminals and power terminals; the shielding plate defines a first row of openings corresponding to the contacting portions, a second row of openings and third row of openings both corresponding to the middle portions, the second row of openings are located in front of the third row of openings. The first row of openings are aligned with the contacting portions of the first terminals and the second terminals in a vertical direction and the second row of openings are at least aligned with gaps between every two adjacent terminals while the shielding plate defines no opening corresponding to the middle portions of the three pair of differential signal terminals so as improve shielding performance.

Other objects, advantages and novel features of the disclosure will become more apparent from the following detailed description when taken in conjunction with the accompanying drawings.

DETAILED DESCRIPTION OF THE PREFERRED EMBODIMENT

Figure 1:
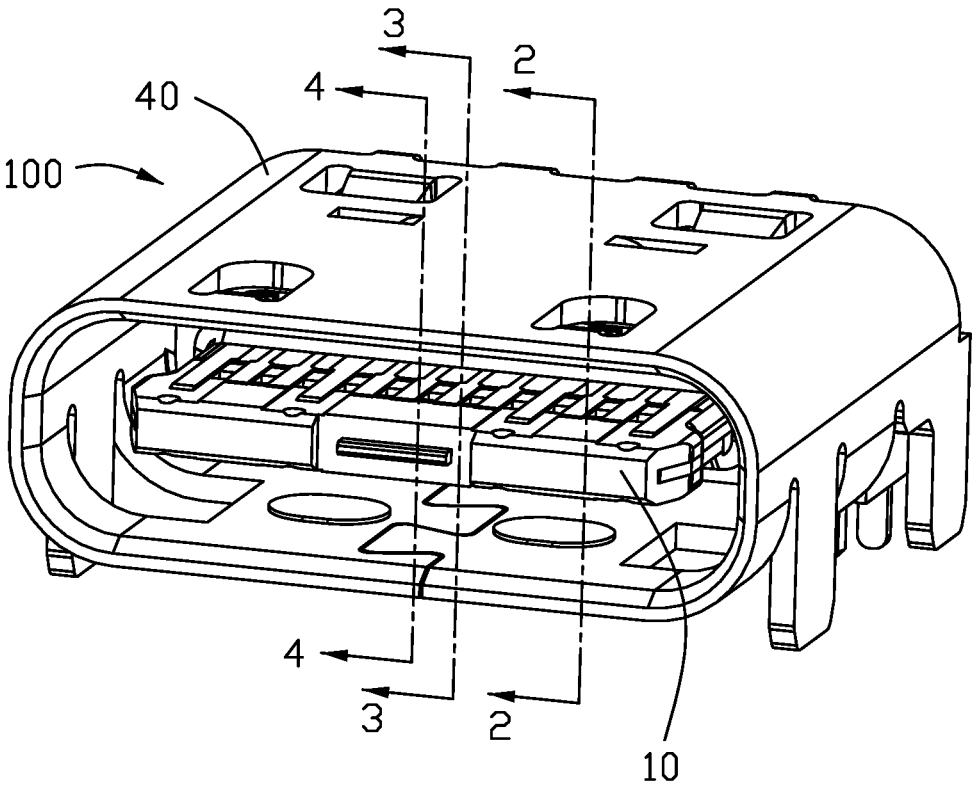
FIG. 1 is a perspective view of an electrical connector according to the first embodiment of the invention.

Reference will now be made in detail to the embodiments of the present disclosure. The reference numerals are only referred to the respective different embodiments.

The first embodiment is shown in FIGS. 1 to 10. The electrical connector 100 includes a terminal module 10 and a metallic shell 40. The terminal module 10 includes a base 11 and a mating tongue 12 extending forward from the base 11, and a row of first terminals 21 and a row of second terminals 22 and a shielding plate 30 commonly embedded in the terminal module 10. In this embodiment, the two rows of terminals and the plate 30 are insert molded within the base 11 and the mating tongue 12 made from insulating material. The mating tongue 12 defines two opposite surfaces 121 and a thickened step 122 at a root to the base 11. The terminals comprise contacting portions exposed upon the surfaces 121 of the mating tongue 12, a middle portion 212 and leg portion 213 perpendicular to the middle portion 212 and extending out the base 11. The shielding plate 30 is disposed between the two opposite surfaces 121 of mating tongue 12. The electrical connector 100 have the USB Type C mechanical configuration mechanically with some variation of the Display Port electrical characters. That is, the electrical connector is promoted in which the differential pair contacts located at positions 2/3 and 10/11 are required to perform the Display Port signals under high frequency transmission.

Figure 5:
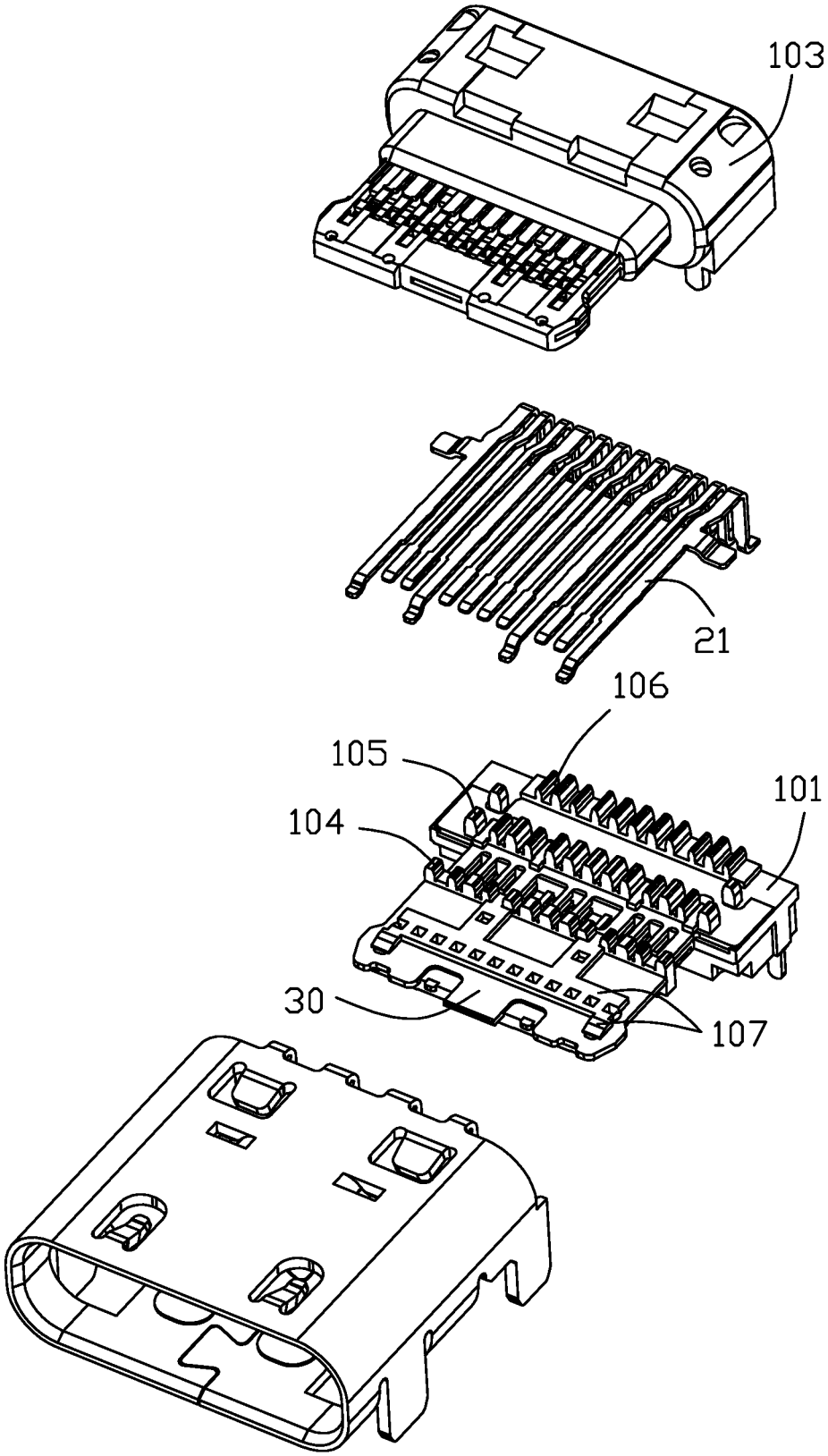
FIG. 5 is an exploded perspective view of the electrical connector of FIG. 1
Figure 6:
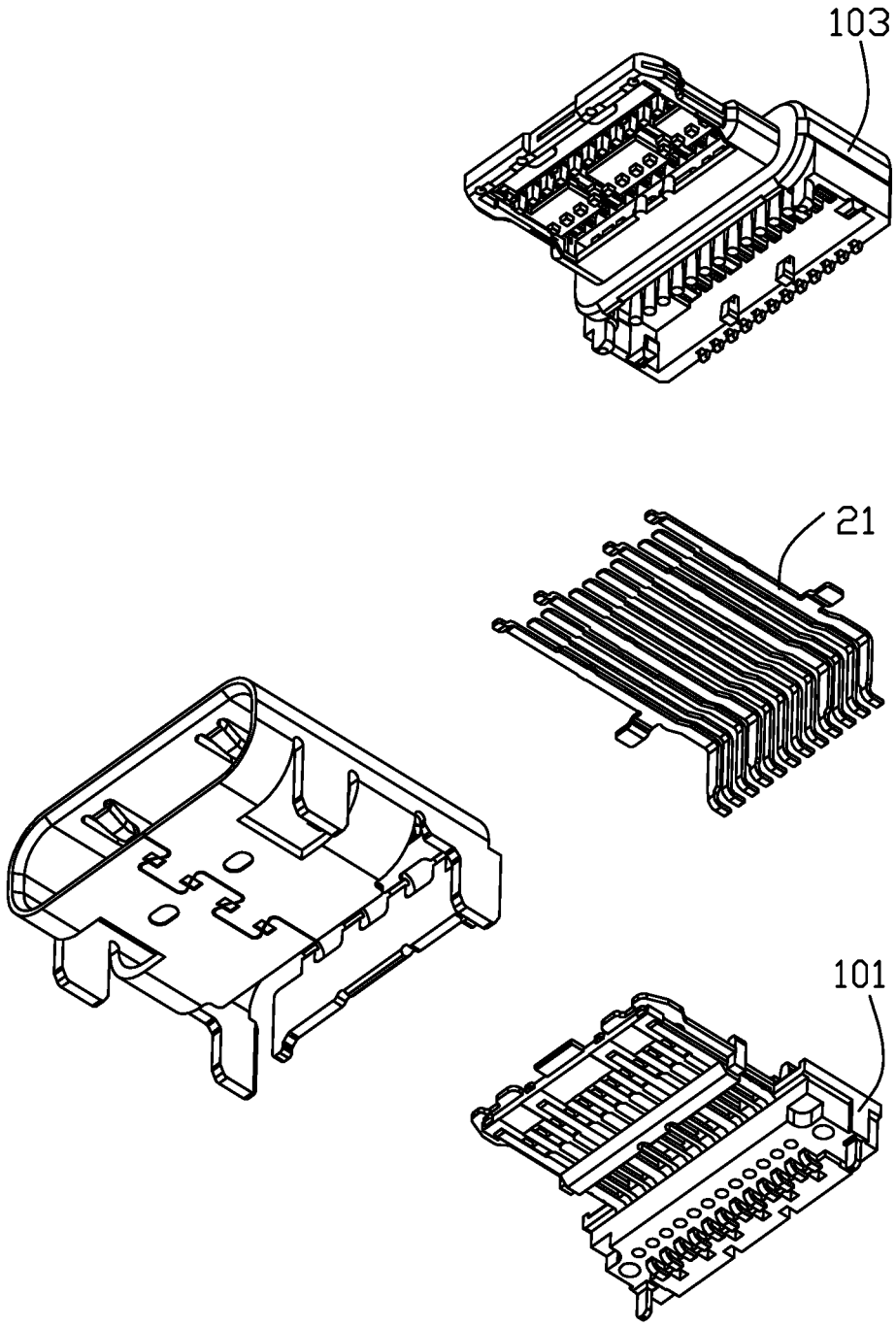
FIG. 6 is another exploded perspective view of the electrical connector of FIG. 5.
Figure 7:
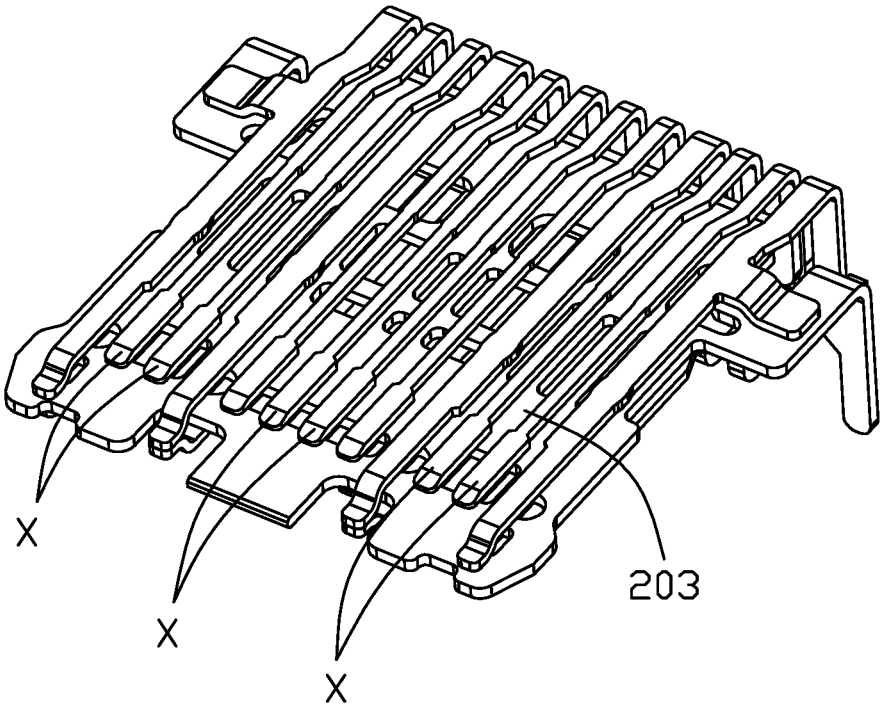
FIG. 7 is a top and front perspective view showing the upper contacts, the lower contacts and the shielding plate therebetween of the contact module of the electrical connector of FIG. 1.

Referring to FIGS. 5 to 6, the row of the second terminals 22 and the shielding plate are insert molded with a first insulator 101, forming a sub-assembly. The sub-assembly defines three ribs 104, 105, 106 on the upper surface of the first insulator 101. The row of first terminals 21 are put on the upper face of the second insulator 103 and separated by the rib. The second insulator 103 is insert molded the sub-assembly so as to form the terminal module 10.

Each row of the first and second terminals 21/22 include three pairs of different signal terminals X and other terminals, such as grounding terminals, power terminals and detecting terminals. There is a gap 203 between every adjacent two terminals 21/22. The shielding plate 30 defining a first row of openings 31 according to the contacting portions 211 of the terminals, a second row of openings 32 and a third row of openings 33 according to the middle portions 212 of the terminals behind the second row of openings 32. The first row of openings 31 are aligned with the contacting portions 211 in vertical direction, while the second row of openings 32 is at least aligned with the gap 203 of every adjacent terminals. The shielding plate 30 do not define any openings aligned with the middle portions of different signal terminals X so that a good performance of anti-EMI between the first and second rows of the terminals in the vertical direction.

Figure 2:
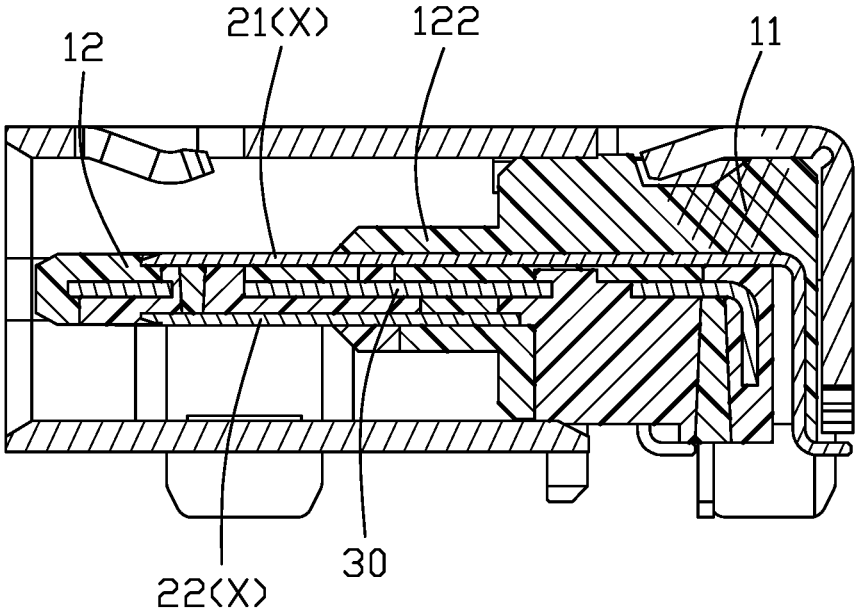
FIG. 2 is a cross sectional view of the electrical connector taken along lines 2-2 in FIG. 1.
Figure 3:
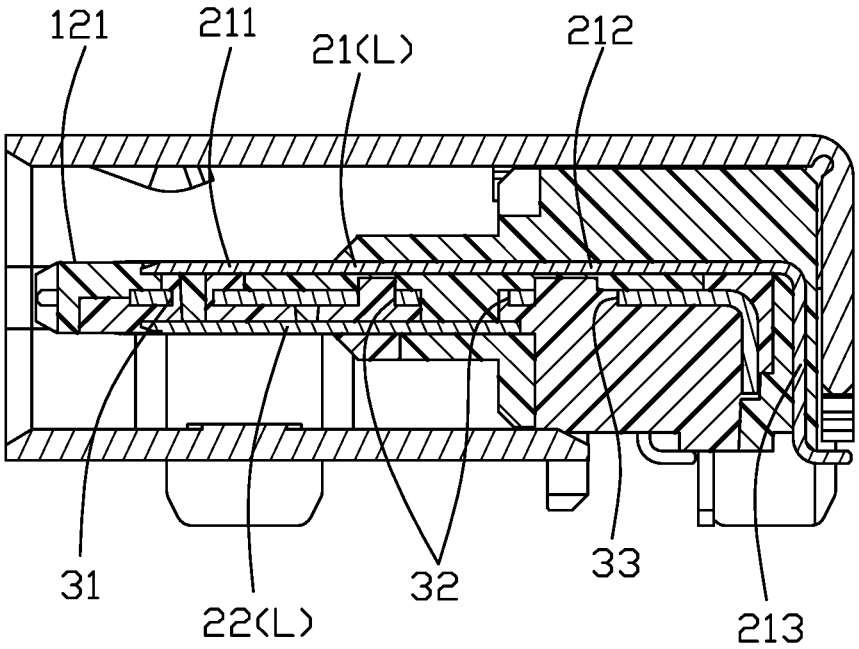
FIG. 3 is a cross sectional view of the electrical connector taken along lines 3-3 in FIG. 1.
Figure 4:
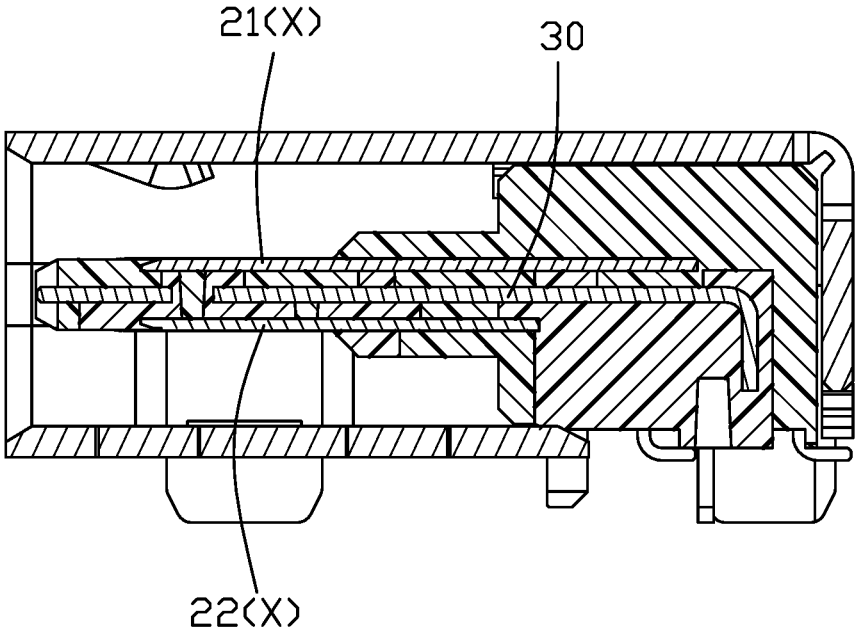
FIG. 4 is a cross sectional view of the electrical connector taken along lines 4-4 in FIG. 1.

The second row of the opening 32 are located within the thickened step 122 in the front-rear direction, the third row of opening 33 are located within the base 11 the front-rear direction. Referring to FIGS. 2-4, all the openings are filled with the insulating material after the insert molding process. In this embodiment, each row of terminals consists of a grounding terminal G, a pair of differential signal terminals X, a power terminal P, a low signal thermals L, a pair of differential signal terminals X, a low signal terminal L, a power terminal P, a pair of differential signal terminals X, a grounding terminal G in turn along a transverse direction perpendicular the front-rear direction and the vertical direction.

The second row of the openings 32 in turn consists of three first openings 32*a*, a second opening 32*b*, a third opening 32*c*, a second hole 32*b*, three first opening 32*a*. Each second opening 32*b* extends laterally across the low signal terminal L and the gap between the power terminal P and low signal terminal L, the first opening 32*a* and the third opening 32*c* are aligned with the gap between every adjacent terminals. Please notes same or similar openings of the shielding plate are labeled with same numerals.

Each first opening 32*a* longitudinally extends in the front-rear direction. Each of the second opening and third opening are divided to two parts, a front part 321 and a rear part 322 which two separate from each other. The rear part 322 is longer than the front part 321 in the front-rear direction.

The first row of opening 31 in turn consists of a first hole 31*a*, a second hole 31*b*, a first hole 31*a*, a third hole 31*c*, a first hole 31*a*, a second hole 31*b*, a first holes 31*a*. The first holes 31*a* are in a circle shape and correspond to the grounding terminals G and the power terminals P. The second holes 31*b* are in a rectangular shape, which laterally extends across one pair of differential signal terminals X and the gap between the pair of terminals. The third holes 31*c* extend across the low signal terminal L, one pair of differential signal terminals X and one low signal terminal L and gaps therebetween.

The shielding plate 30 further defines a fourth row of opening 34 located in front of the first row of opening 31. The openings 34 of the fourth row are aligned with the contacting portions 211 of the power terminals P one by one.

During the insert-molding process of the row of second terminals 22 and the shielding plate 30, tool core pins go through the first row of openings 31 and press against the contacting portions 211 of the second terminals 22, the insulating material simultaneously flows to another side of the shielding plate 30 through the first row of openings 31 to form a front supporting platform 107 as shown in FIG. 5. As shown in FIG. 5, the insulating material flows to another side of the shielding plate 30 through the fourth row of openings 34 to form two end portions of the front supporting platform 107, through the front part 321 of the second row of openings 32 to form the row of front ribs 104 and the row of middle ribs 105, through the third row of openings 33 to form the row of rear ribs 106. Tools cut away bridge strip between the every adjacent terminals through the rear parts 322 of the second row of the opening 32.

Figure 8:
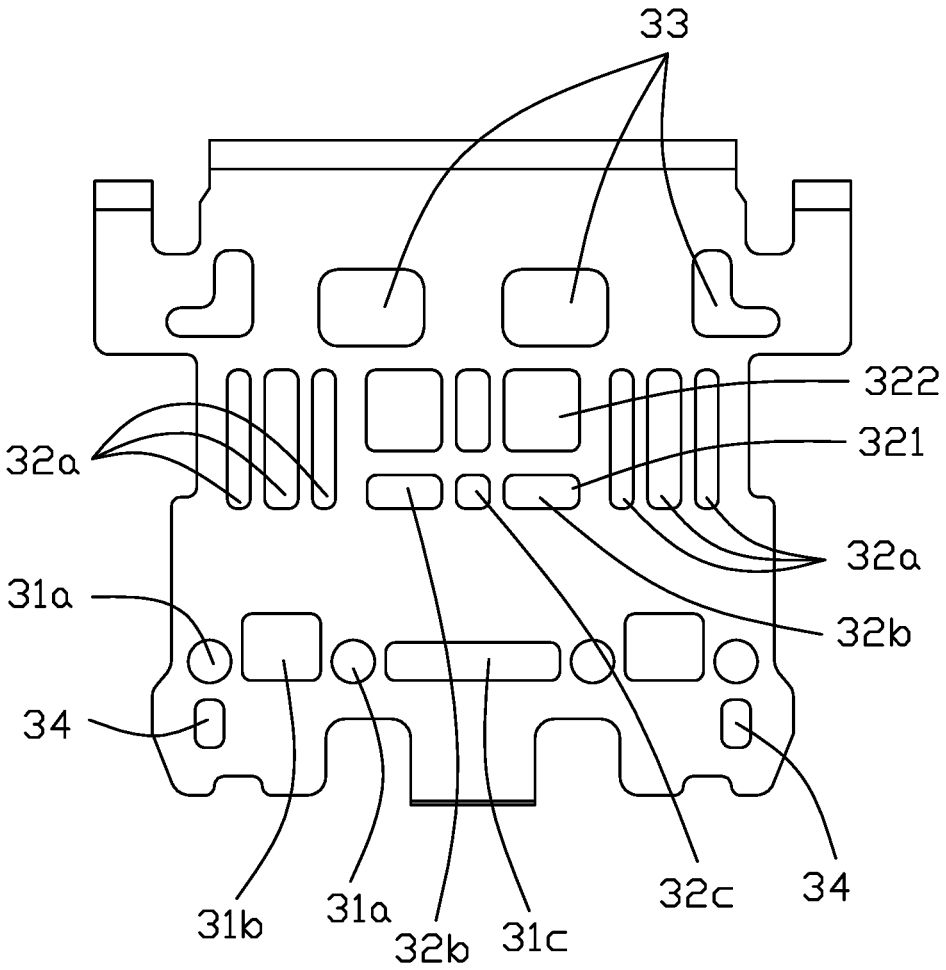
FIG. 8 is a top view of the shielding plate in FIG. 7.
Figure 9:
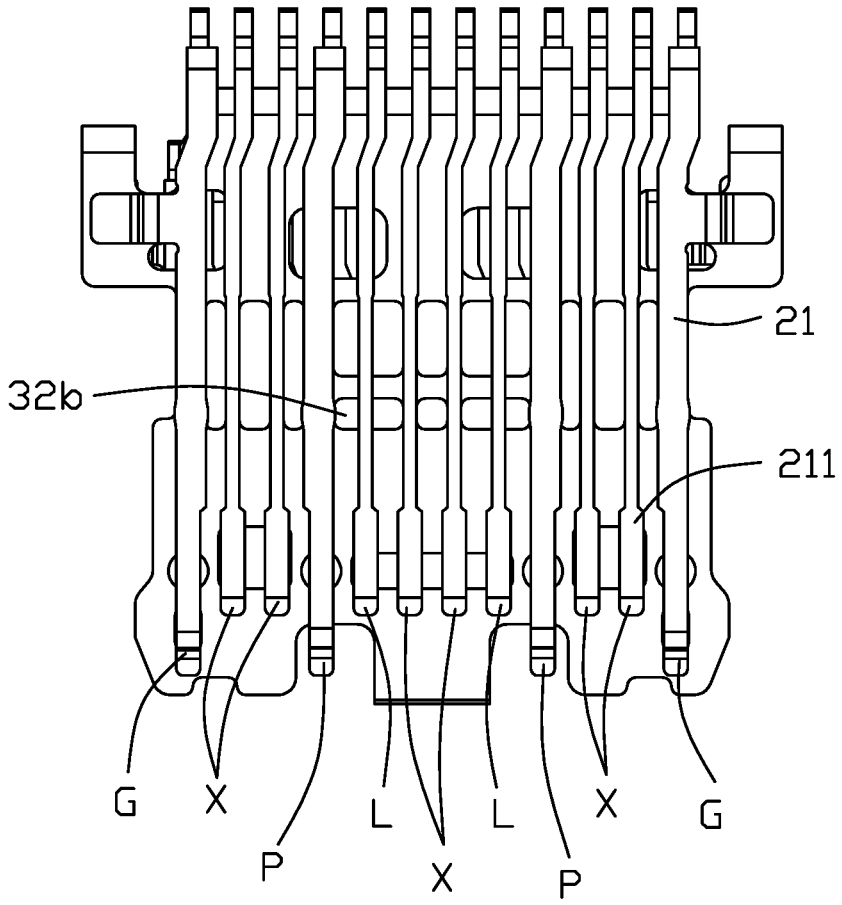
FIG. 9 is a top view of FIG. 7.
Figure 10:
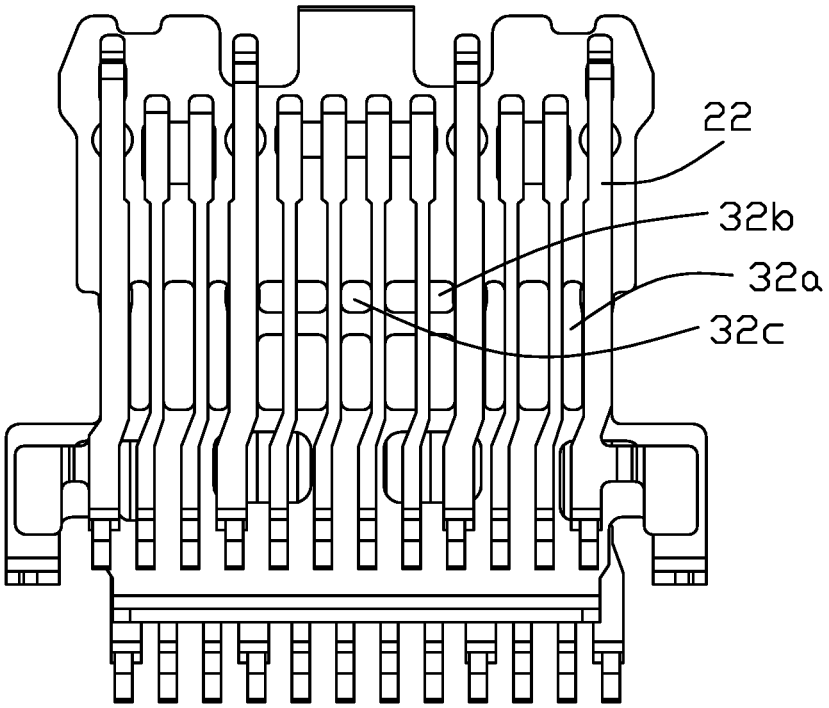
FIG. 10 is a bottom view of FIG. 7.
Figure 11:
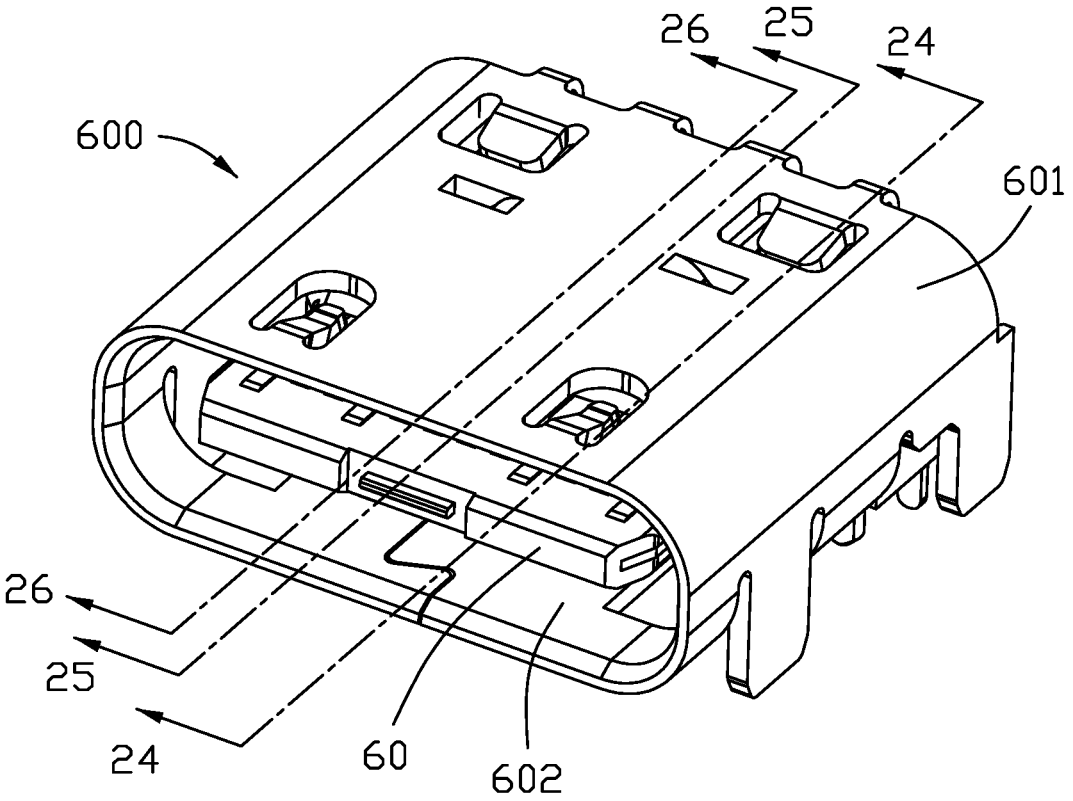
FIG. 11 is a perspective view of the electrical connector according to a second embodiment of the invention.
Figure 12A:
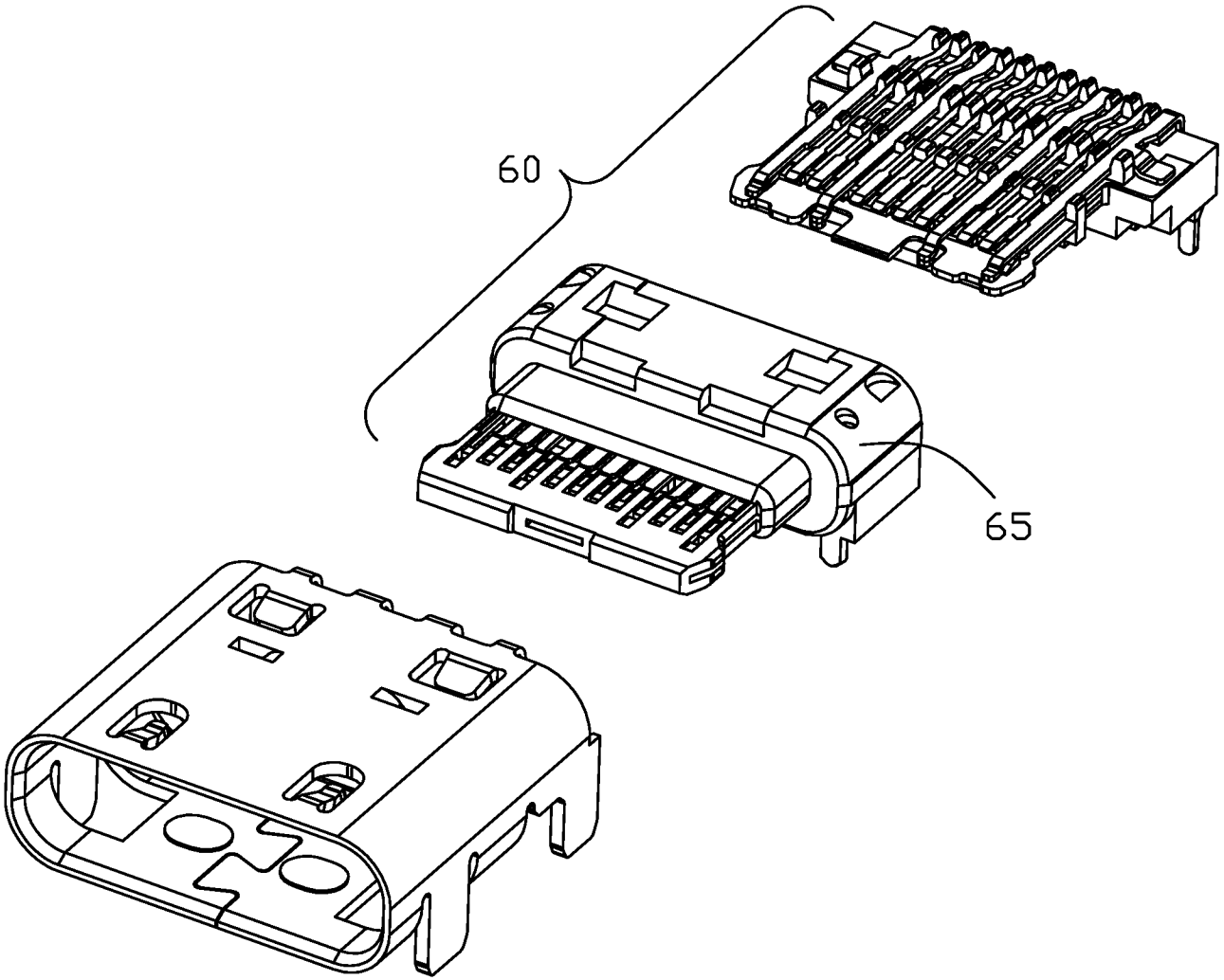
FIG. 12(A) is an exploded perspective view of the electrical connector of FIG. 11.
Figure 12B:
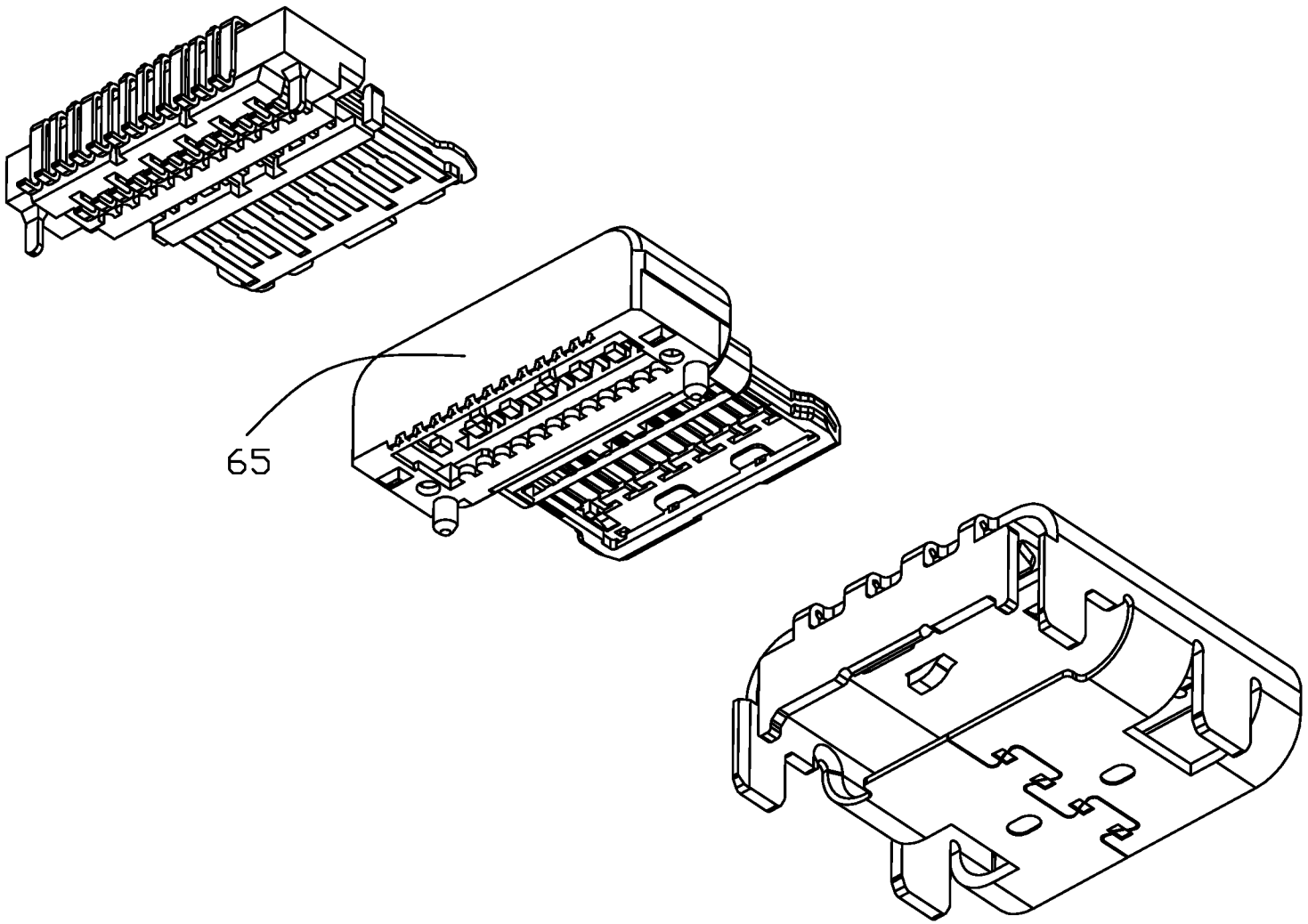
FIG. 12(B) is another exploded perspective view of the electrical connector of FIG. 12(A)
Figure 13:
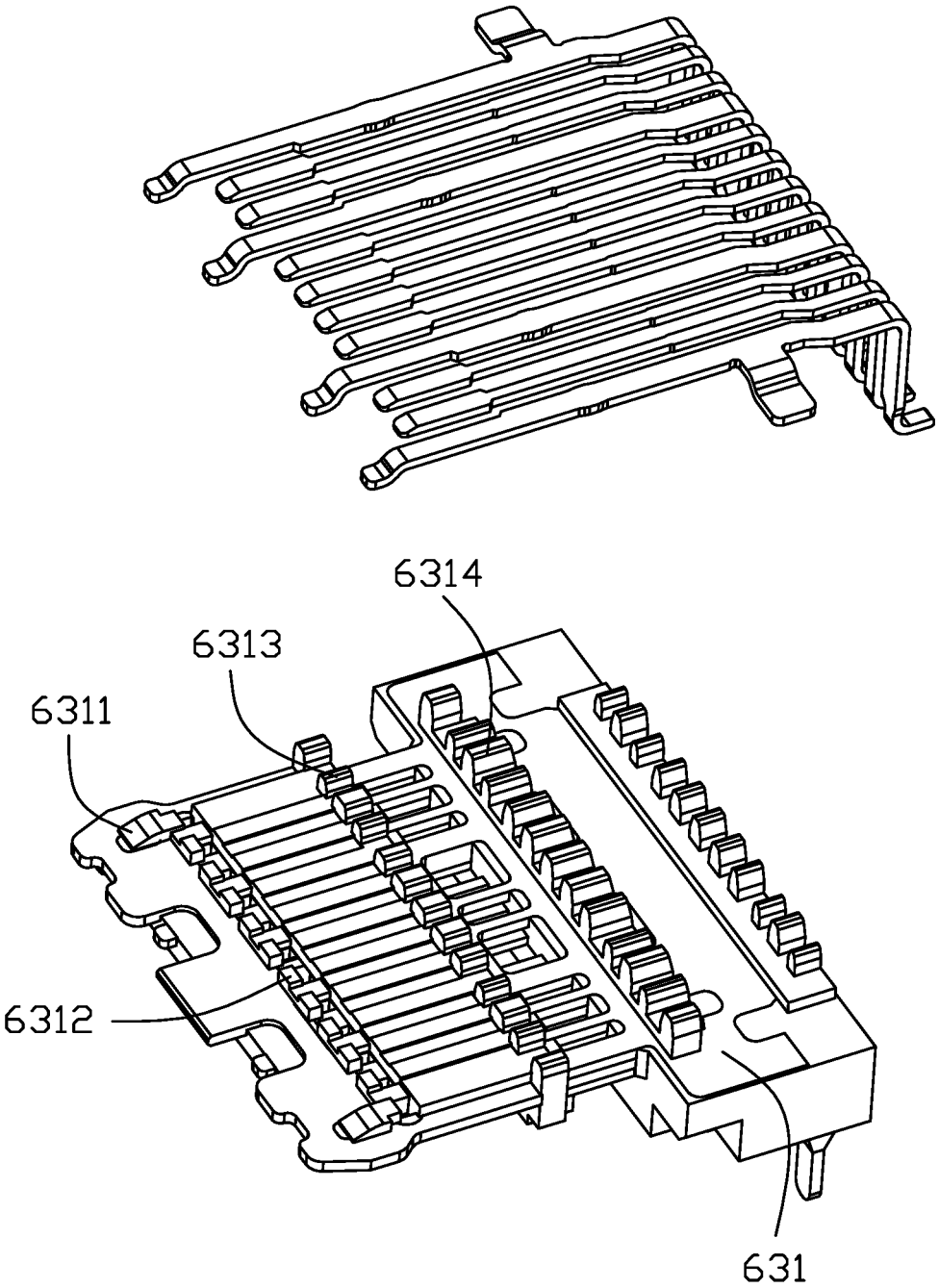
FIG. 13 is an exploded perspective view of the contact module of the electrical connector of FIG. 11 without the outer insulator.
Figure 14:
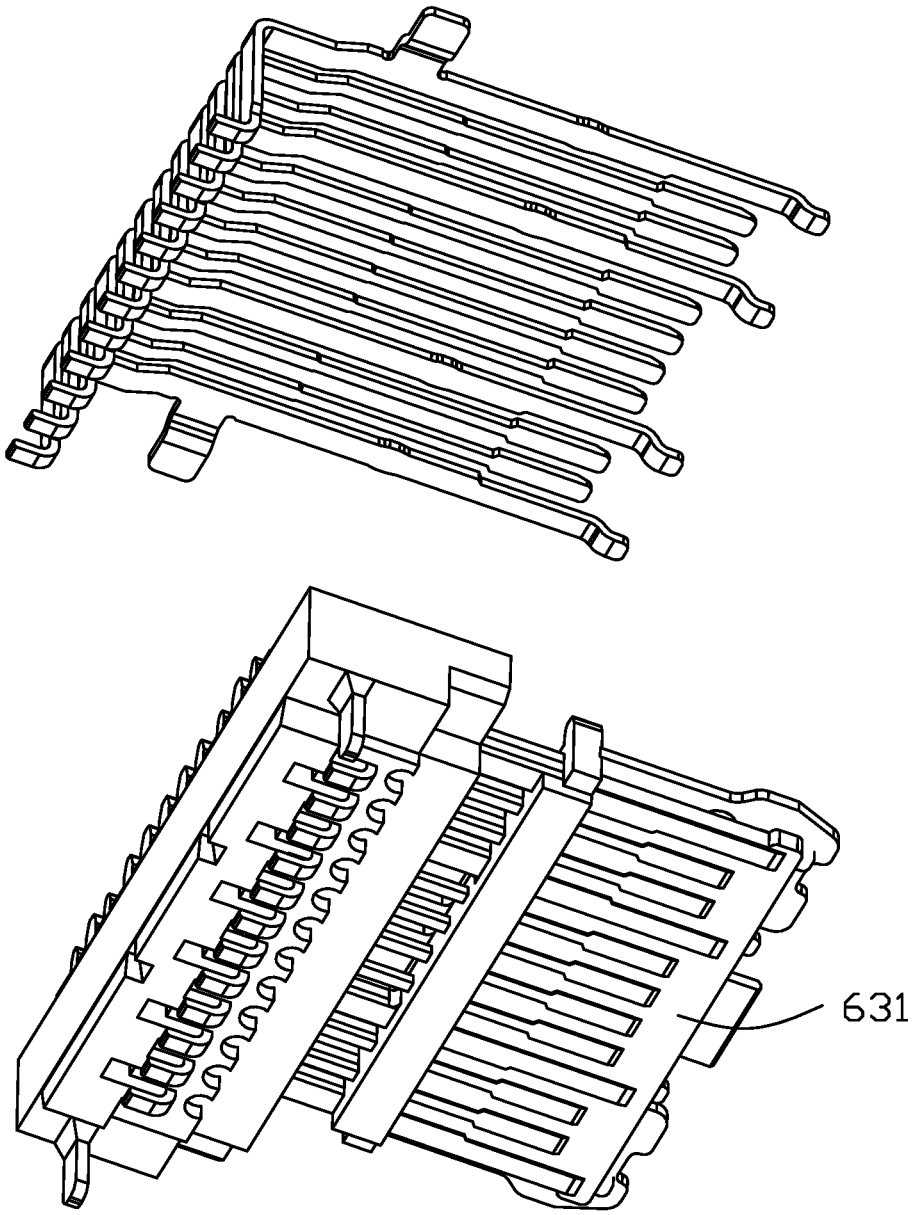
FIG. 14 is another exploded perspective view of the contact module of the electrical connector of FIG. 13.
Figure 15:
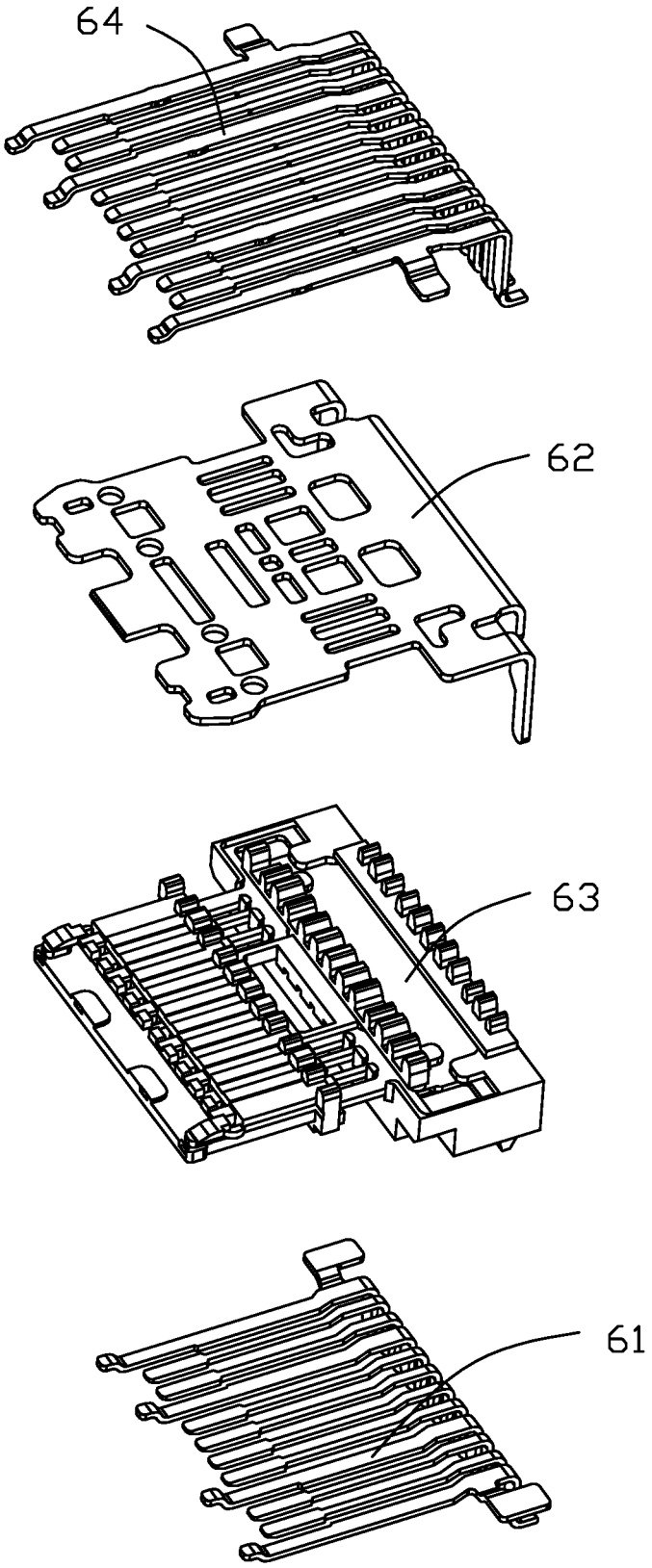
FIG. 15 is a further exploded perspective view of the contact module of the electrical connector of FIG. 13.
Figure 16:
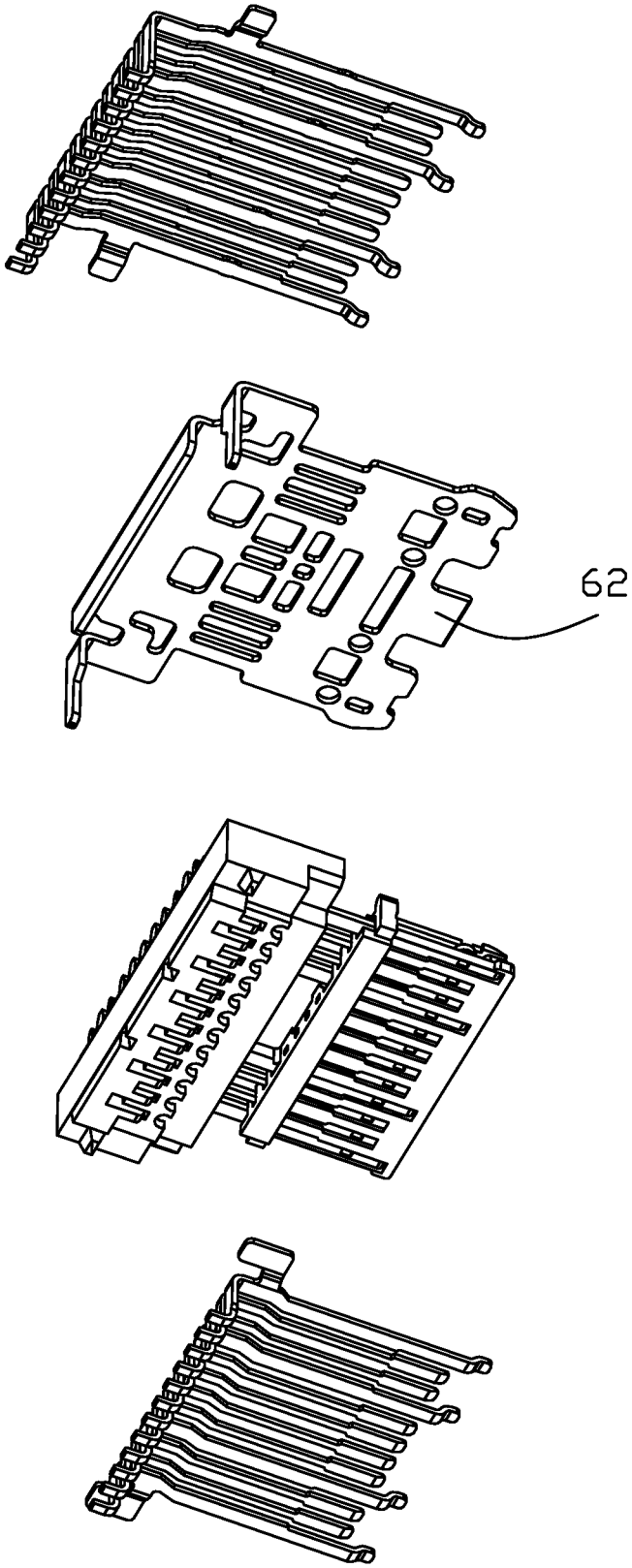
FIG. 16 is another further exploded perspective view of the contact module of the electrical connector of FIG. 15.
Figure 17:
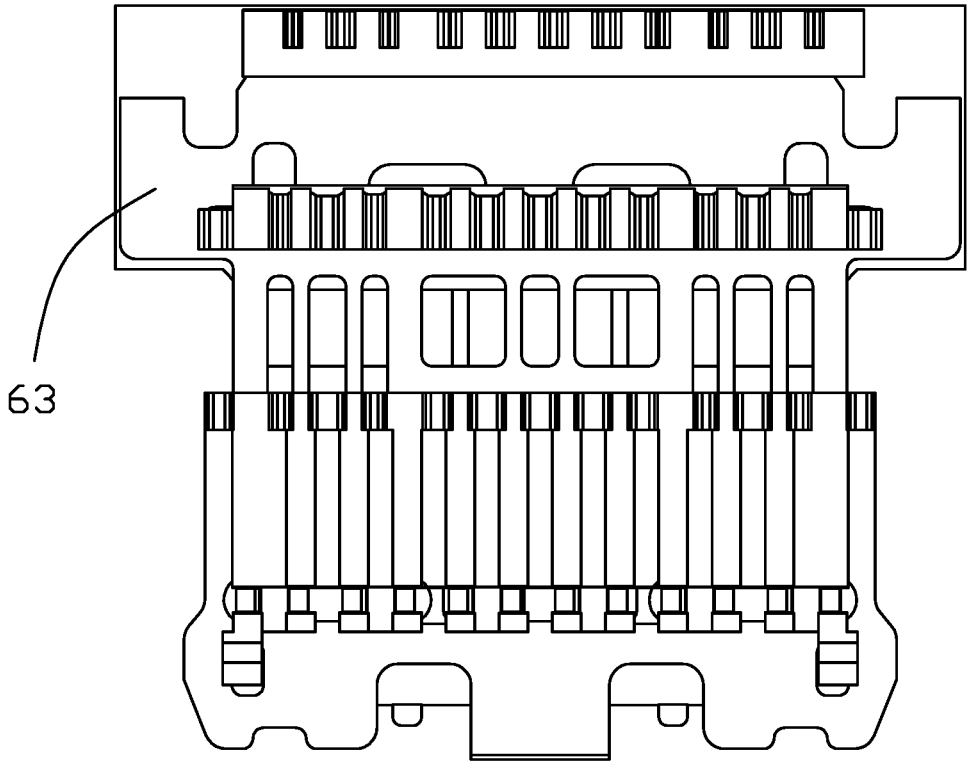
FIG. 17 is a top view of the contact module of the electrical connector of FIG. 12 without the upper contacts.
Figure 18:
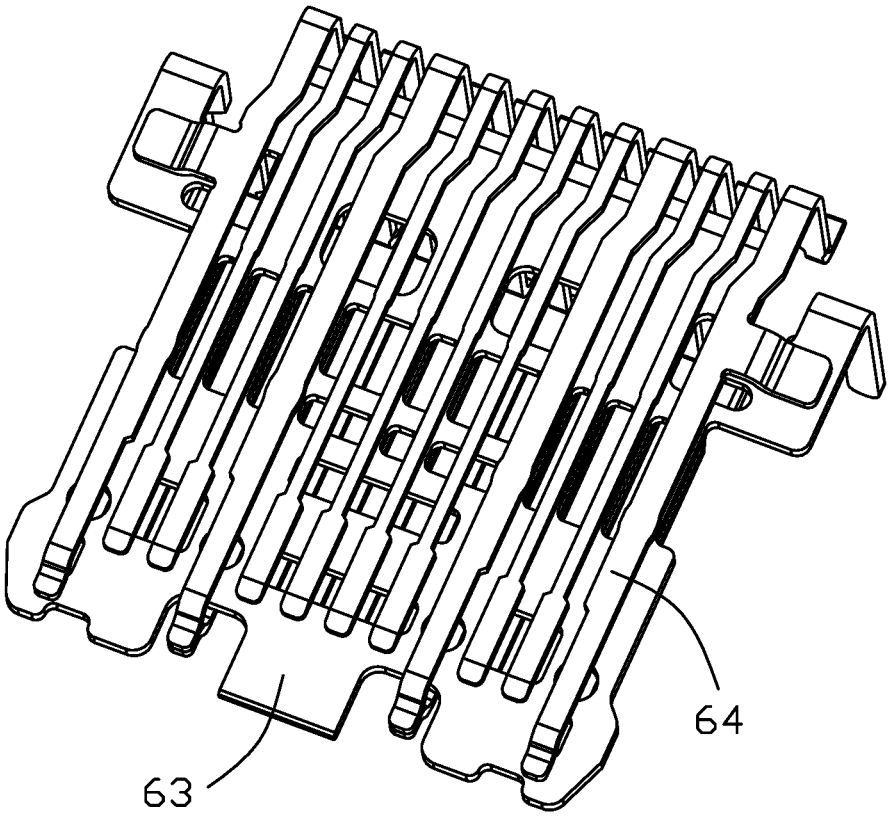
FIG. 18 is a perspective view showing the upper contacts, the lower contacts and the shielding plate therebetween of the contact module of the electrical connector of FIG. 13.
Figure 19:
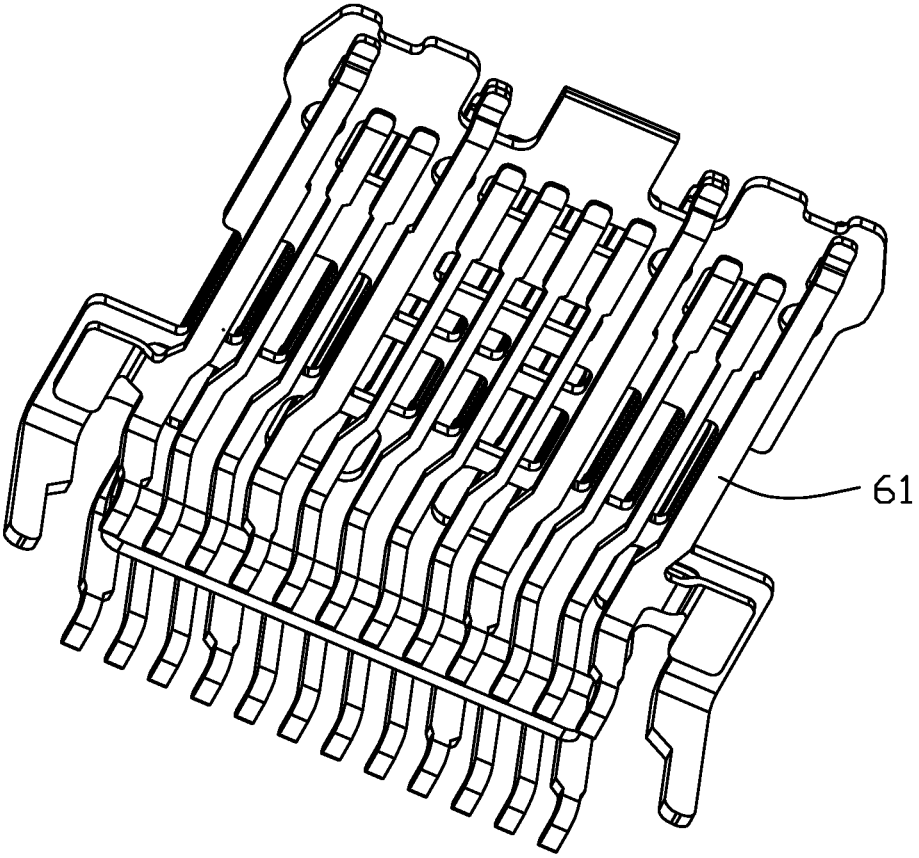
FIG. 19 is another perspective view of FIG. 18.

FIGS. 11-26 show a second embodiment of the invention which is similar to the first embodiment and essentially discloses another improvement with regard to the design shown in FIG. 8 by adding a transversely extending hole 150D located between the holes 150C and 150E.

Figure 20:
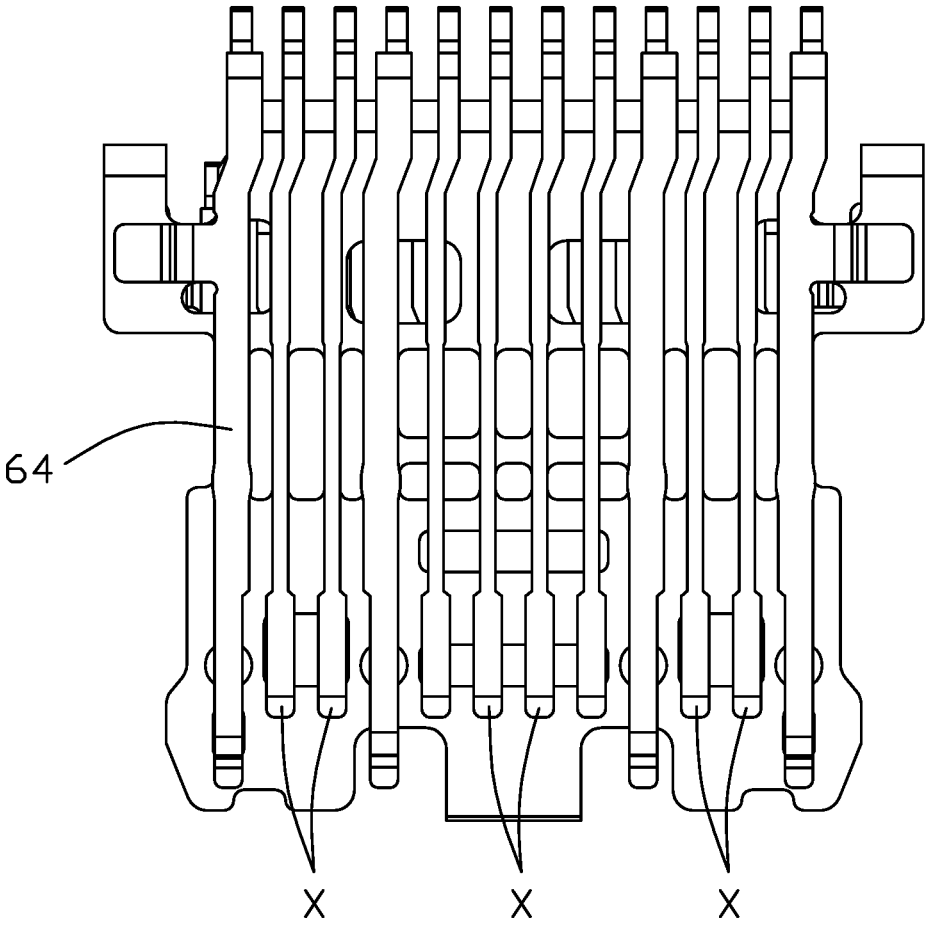
FIG. 20 is a top view showing the upper contacts, the lower contacts and the shielding plate therebetween of the contact module of the electrical connector of FIG. 18
Figure 21:
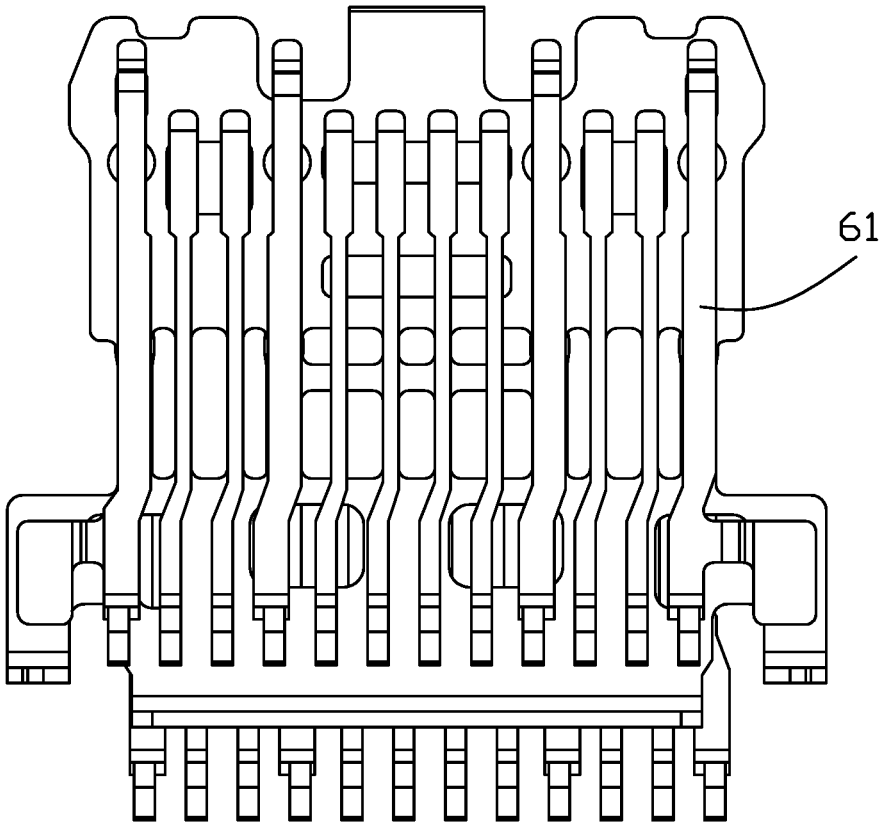
FIG. 21 is a bottom view of FIG. 18.
Figure 22:
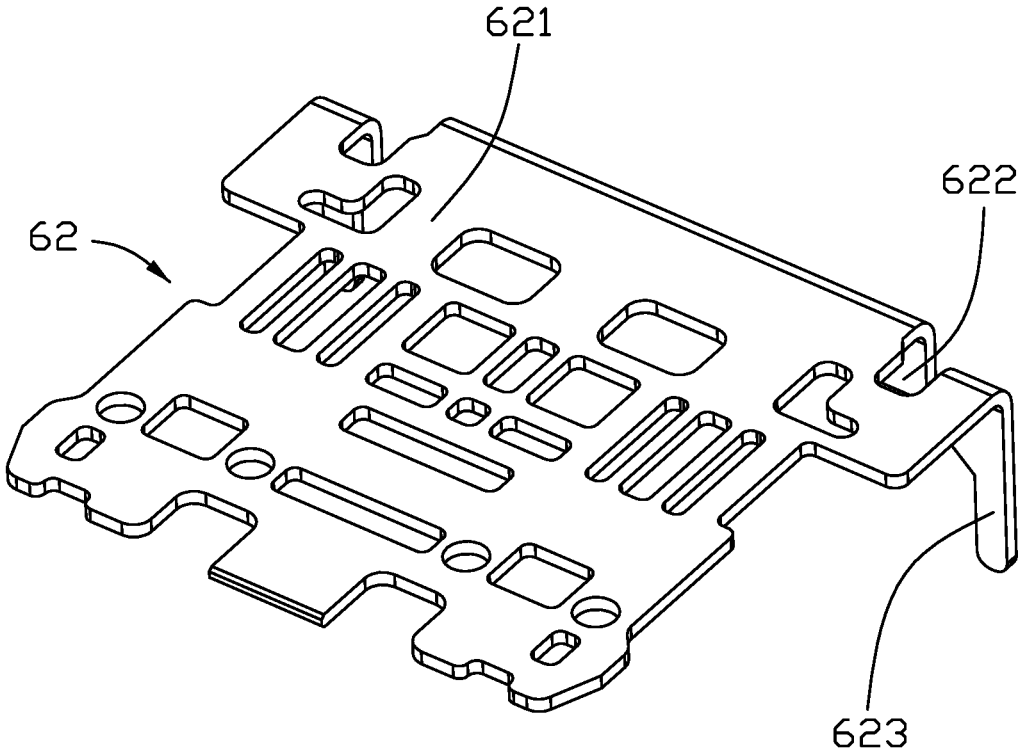
FIG. 22 is a perspective view of the shielding plate of the contact module of the electrical connector of FIG. 18.
Figure 23:
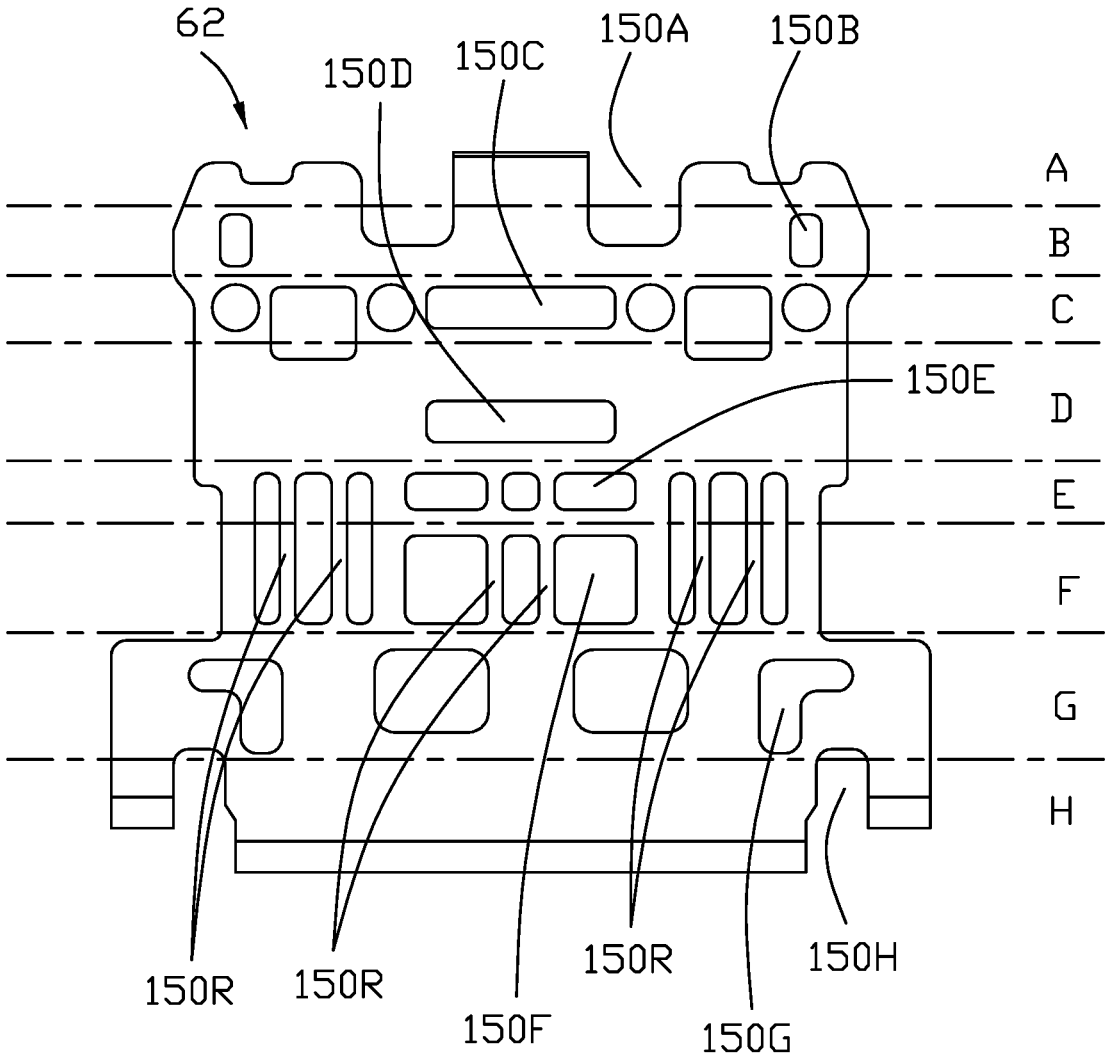
FIG. 23 is a top view of the shielding plate of FIG. 22.
Figure 24:
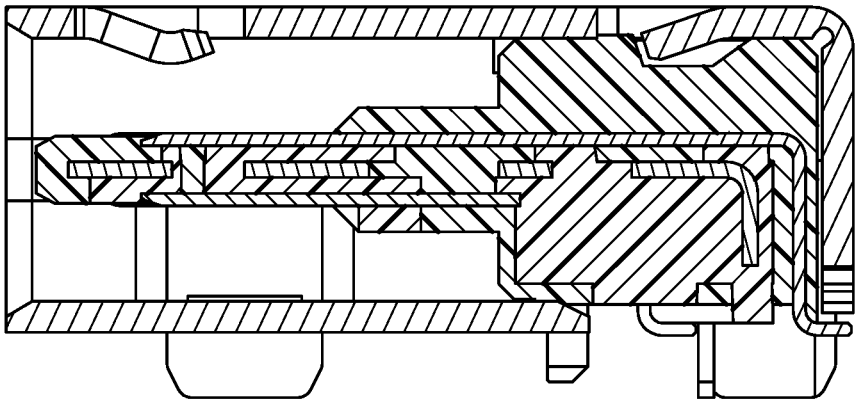
FIG. 24 is a cross-sectional view of the electrical connector of FIG. 11 along line 24-24.
Figure 25:
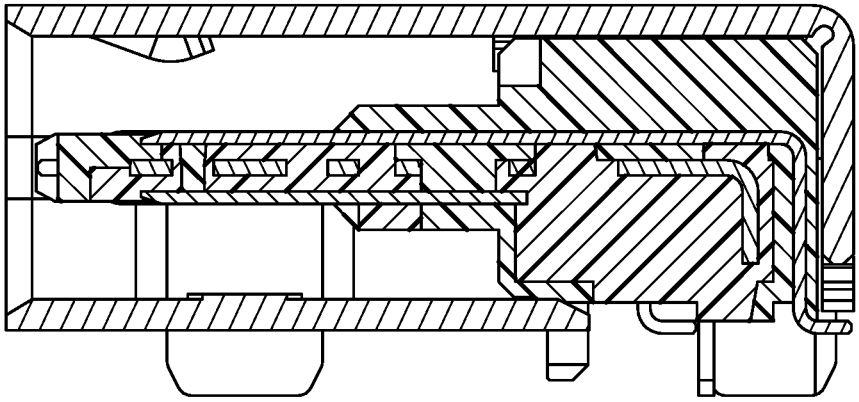
FIG. 25 is a cross-sectional view of the electrical connector of FIG. 11 along line 25-25.
Figure 26:
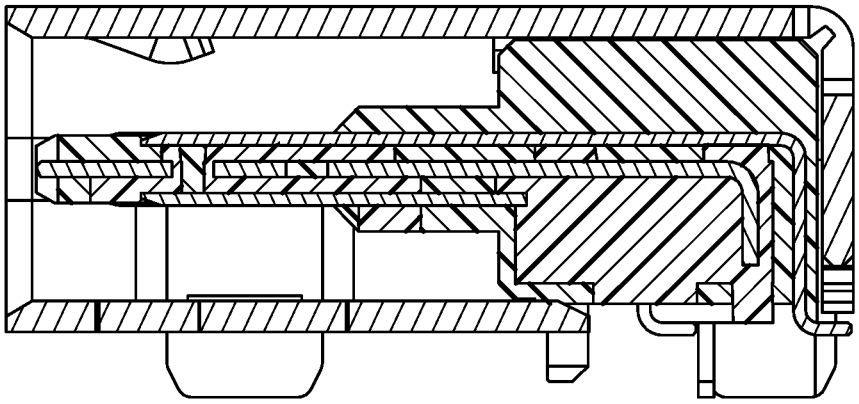
FIG. 26 is a cross-sectional view of the electrical connector of FIG. 11 along line 26-26.

Similar to those in the first embodiment, the electrical connector includes a metallic shield 601 and a terminal module 60 received within the metallic shield 601 to commonly form a mating cavity 602 for receiving a complementary plug connector. The terminal module 60 of the electrical connector 600 is made via two-stage insert-molding process. Anyhow, other manufacturing methods are available understandably. In this embodiment, the terminal module 60 includes a plurality of lower contacts 61 in one row and a metallic shielding plate 62 initially integrally formed within an inner insulator 63 to commonly form a contact subassembly 631 via a first stage insert-molding process, and further successively cooperating with a plurality of upper contacts 64 in another row to be integrally formed within an outer insulator 65 to form the complete contact module 60 via a second stage insert-molding process. The inner insulator 63 and the outer insulator 65 commonly form an insulative housing including a rear base and a front mating tongue extending forwardly from the base along the front-to-back direction. Notably, the mating tongue includes a thickened/stepped portion around the root joined with the base according to the USB Type C specification. The upper terminals 64 as well as the lower terminals 61 defining twelve positions along a transverse direction perpendicular to both the front-to-back direction and the vertical direction as shown in FIG. 20 front left to right, the terminals at positions 2/3, 6/7 and 10/11 are high speed differential pairs, i.e., three pair of differential terminals X. The contacting sections of the contacts are exposed upon the mating tongue.

The shielding plate 63 includes a horizontal main body 621, a rear wall 622 and a pair of mounting legs 623 by two sides of the rear wall 622 wherein the rear wall 622 and the pair of mounting legs 623 commonly extend from the rear edge of the main body 621. The mina body 621 can be categorized with different zones, along the front-to-back direction, with corresponding holes/notches performing the respective effects. Holes 150A in zone A allows the power contacts contact each other in the vertical direction. Holes 150B in zone B allow the two opposite big outermost protrusions 6311 on the upper side extend therethrough so as to be unitarily linked with the other two opposite being outermost protrusions 6311 on the lower side. Holes 150C in zone C allows the corresponding core pins to support the front end of the lower contacts 61 during the first stage insert-molding process. Holes 150E in zone E are used to form the front row of ribs 6312. Holes 150F in zone F are used to break the bridges linked between the contact carrier between every adjacent two lower contacts 61. Holes 150G in zone G are used to form the middle row of ribs 6313. Holes 150H in zone H are used to form the rear row of ribs 6314.

The hole 150D is used to support the lower contacts 61 during the first stage insert-molding process. Similar to the holes 150C integrally formed as one along the transverse direction in the first embodiment, the holes 150C corresponding to positions 5-8 as well as the holes 150D corresponding to positions 5-8 are integrally formed together so as to be shown as only a single one hole 150C and a single one hole 150D. From a technical viewpoint, in the first embodiment around the area between the position 4 and position 6, the holes are joined together from zone D to zone H in the front-to-back direction. Notably, in both embodiments some holes 150E are also joined with some holes 150F. In other words, both embodiments of the invention are improvements by providing new arrangement of the holes in the shielding plate for both mechanical and electrical consideration. Notably, in this embodiment, the contacting sections of the contacts at positions 1, 4, 9 and 12 are wider than those of others. There are three groups of holes 150F and each group includes three holes 150F with two ribs 150R therebetween wherein each rib 150R is aligned with the corresponding high speed contact. In other words, the contacting sections of the contacts at positions 2, 3, 6, 7, 10 and 11 are aligned with the corresponding ribs 150R in the vertical direction. Understandably, such ribs 150R are used to prevent crosstalk between the contacting section of the high speed contact of the upper row and that of the high speed contact of the lower row which are essentially aligned with each other in the vertical direction. In brief, as mentioned earlier, how to arrange the holes in the shielding plate for not only performing the required electrical effect but also satisfying the required mechanical effect including the strength and manufacturability thereof via multiple insert-molding processes, is of a very delicate matter because most of time they are contradictory with each other. The invention systematically and symmetrically forms a plurality of holes, which are arranged with one another along the transverse direction, in different zones which are arranged with one another in the front-to-back direction, so as to achieve the required effects, mechanically and electrically.

While a preferred embodiment in accordance with the present disclosure has been shown and described, equivalent modifications and changes known to persons skilled in the art according to the spirit of the present disclosure are considered within the scope of the present disclosure as described in the appended claims.

What is claimed is:

1. An electrical connector comprising:

a terminal module comprising a base, a mating tongue extending from the base and defining two opposite surface, and a row of first terminals, a row of second terminals and a shielding plate embedded in the base and the mating tongue;

the mating tongue defines a thickened step at a root to the base;

the first terminals and the second terminals comprising contacting portions, middle portions and leg portions bending from rear ends of the middle portions;

the shielding plate located between the two opposite surfaces;

wherein each row of first and second terminals comprising three pairs of differential signal terminals, and grounding terminals and power terminals; the shielding plate defines a first row of openings corresponding to the contacting portions, a second row of openings and third row of openings both corresponding to the middle portions, the second row of openings are located in front of the third row of openings;

wherein the first row of openings are aligned with the contacting portions of the first terminals and the second terminals in a vertical direction and the second row of openings are at least aligned with gaps between every two adjacent terminals while the shielding plate defines no opening corresponding to the whole middle portions of the three pair of differential signal terminals so as improve shielding performance.

2. The electrical connector as claimed in claim 1, wherein the shielding plate and the row of second terminals are formed by insert molded process.

3. The electrical connector as claimed in claim 1, wherein the second row of openings are aligned with the thicken step and the third row of openings are disposed in the base.

4. The electrical connector as claimed in claim 1, wherein each row of first terminals and second terminals consists of a grounding terminal, a pair of differential signal terminals, a power terminals, a low signal terminal, a pair of differential signal terminals, a low signal terminal, a power terminal and a pair of differential signal terminals and a grounding terminal in turn along a transverse direction.

5. The electrical connector as claimed in claim 4, wherein the shielding plate further defines a fourth of openings which locates in front of the first row of openings and are aligned with the corresponding contacting portions of the power terminals.

6. The electrical connector as claimed in claim 4, wherein the first row of openings consist of a first hole, a second hole, a first hole, a third hole, a first hole, a second hole, a first hole, the first holes are in an circle shape and aligned with the grounding terminals and the power terminals, the second holes are in a rectangular shape and extend across one pair of differential signal terminals and the gap between them; the third holes are in a rectangular shape in transverse direction and extend across the low signal terminals, one pair of differential signal terminals, the low signal terminals and gaps between them.

7. The electrical connector as claimed in claim 4, wherein the second row of openings consist of three first opening, a second opening, a third opening, a second opening, three first opening, each second opening extend across the power terminal and the lower signal terminals and gap between them; the first and third openings are aligned with corresponding gaps of two adjacent terminals.

8. The electrical connector as claimed in claim 7, wherein the first openings are in a rectangular shape in the front-rear direction.

9. The electrical connector as claimed in claim 7, wherein the second and third holes are divided into a front part and a rear part distinct from the front part; the rear part is longer than the front part in the front-rear direction.

10. The electrical connector as claimed in claim 1, wherein the shielding plate further defines a fifth opening.

11. An electrical connector comprising:

a metallic shield;

a terminal module received within the metallic shield to commonly form a mating cavity for receiving a complementary plug connector, the terminal module including an insulating housing with a base and mating tongue extending forwardly from the base in a front-to-back direction;

a plurality of terminals including a row of lower contacts and another row of upper contacts with a metallic shielding plate therebetween integrally formed within the insulating housing in a vertical direction perpendicular to the front-to-back direction;

the upper terminals as well as the lower terminals defining twelve positions along a transverse direction perpendicular to both the front-to-back direction and the vertical direction;

wherein the terminals at positions 2/3, 6/7 and 10/11 are high speed differential pairs.

12. The electrical connector as claimed in claim 11, wherein the lower terminals and the shielding plate are initially integrally formed with an inner insulator and successively along with the upper terminals to be commonly integrally formed within an outer insulator to form the complete terminal module.

13. The electrical connector as claimed in claim 12, wherein the shielding plate further including a plurality of respective holes in different zones which are arranged along the front-to-back direction, and some of said holes are positioned and configured to be filled with the inner insulator, others of the holes are positioned and configured to be filled with the outer insulator, and remainders are positioned and configured to be filled with both the inner insulator and the outer insulator.

14. The electrical connector as claimed in claim 13, wherein the inner insulator forms at least one row of ribs located above an upper surface of the shielding plate and alternately arranged with the upper terminals in the transverse direction, and some holes are aligned with the ribs in the vertical direction.

15. The electrical connector as claimed in claim 11, wherein some of the holes are respectively aligned with the corresponding terminals in the vertical direction in a one-to-one relation while some of said holes are integrally formed as one big hole in the transverse direction aligned with multiple terminals in the vertical direction in a one-to-two or more relation.

16. An electrical connector comprising:

a terminal module including opposite upper and lower rows of contacts with a metallic shielding plate therebetween in a vertical direction and commonly integrally formed within an insulator which forms a front mating tongue thereof along a front-to-back direction perpendicular to the vertical direction;

each row of contacts having twelve contacts spaced from one another from position one to position twelve along a transverse direction perpendicular to both the vertical direction and the front-to-back direction;

each of said contacts having a contacting section exposed upon a corresponding surface of the mating tongue wherein in each row the contacting sections of the contacts at position one, four, nine and twelve are wider than those of others;

the shielding plate defining a plurality of zones along the front-to-back direction and a plurality of holes spaced from each other in each zone in the transverse direction; wherein the holes in a first zone in a front region of the shielding plate are aligned with the contacting sections of all the twelve contacts in each row while the holes in a second zone in a middle region of the shielding plate are not aligned with the contacting sections of the corresponding contacts in each row but in an offset manner so as to have corresponding ribs formed in and further extend through said holes in the second zone in the vertical direction to sandwich the corresponding contacts therebetween in the transverse direction.

17. The electrical connector as claimed in claim 16, wherein there are three groups of the holes in the second zone, and each group has three holes.

18. The electrical connector as claimed in claim 16, wherein the holes in the first zone includes four circular holes and three rectangular holes alternately arranged with each other in the transverse direction, sand said circular holes are aligned with the contacting sections of contacts at positions one, four, nine and twelve.

19. The electrical connector as claimed in claim 16, wherein there are two holes in a third zone in front of the first zone, and said two holes in the third zone are aligned with the contacting sections of the contacts at position one and twelve.

20. The electrical connector as claimed in claim 11, wherein most portions of the shielding plate keep completeness at positions 2/3, 6/7 and 10/11.

* * * * *